United States Patent [19]

Check

[11] 4,345,297

[45] Aug. 17, 1982

[54] ELECTRONIC STATIC DISCHARGE APPARATUS

[76] Inventor: Alex J. Check, 827 Fourth St., Santa Monica, Calif. 90403

[21] Appl. No.: 132,887

[22] Filed: Mar. 24, 1980

[51] Int. Cl.[3] ..... H05F 3/06

[52] U.S. Cl. ..... 361/215; 361/222; 361/225; 68/18 R; 250/432 R

[58] Field of Search ..... 361/215, 222, 213, 225; 250/432 R, 436, 438; 68/18 R

[56] References Cited

U.S. PATENT DOCUMENTS

| | | | |
|---|---|---|---|
| 1,991,934 | 2/1935 | McCray | 250/436 |
| 2,647,233 | 7/1953 | Check | 361/225 |
| 3,784,876 | 1/1974 | De Gaston | 361/215 |
| 4,057,071 | 11/1977 | Rhodes | 361/215 |

*Primary Examiner*—J. D. Miller
*Assistant Examiner*—L. C. Schroeder
*Attorney, Agent, or Firm*—Harpman & Harpman

[57] ABSTRACT

A device for discharging an electrostatic field in a dry cleaning washer positions a source of radioactive material from which electrons flow in a fluid path in said washer, a grounded receiving antenna is arranged in spaced relation to said radioactive material.

4 Claims, 2 Drawing Figures

ELECTRONIC STATIC DISCHARGE APPARATUS

BACKGROUND OF THE INVENTION

1. Field of the Invention

This invention relates to devices for discharging electro static fields in dry cleaning machines.

2. Description of the Prior Art

The known prior art devices are best illustrated in my earlier U.S. Pat. No. 2,647,223 of July 28, 1953. In that patent, a rod like collecting electrode was positioned in a fluid path in a dry cleaning machine, a power source was provided and one end of the collecting electrode was connected to a ground. A transformer in connection with the power source along with a rectifier in connection with the secondary of the transformer provided a current which was directed through the collecting electrode to ground. The electrons comprising part of the electro static field generated in the dry cleaning machine were removed from the dry cleaning machine by the grounding electrode and the current flowing there through. In the present invention, the grounding device is installed in a fluid path in a dry cleaning machine and utilizes radio active material positioned on a conductor in spaced relation to a receiving antenna in the fluid path. Electrons and the like flowing from the radioactive source toward the receiving antenna form a radiation path by ionization for the electrons comprising the electro static field in the fluid path to the receiving antenna which is grounded to a ground externally of the dry cleaning machine.

SUMMARY OF THE INVENTION

An electronic static discharge device is disclosed which is useful in continuously discharging static electricity from fluids such as solvents employed in dry cleaning operations to prevent the redeposition of soil particles in garments being cleaned in the solvent. The device comprises a fluid path for the solvent or other fluid in communication with the dry cleaning machine and the positioning of a radioactive source such as a pallet of material containing trace amounts of radium, actinium, uranium, thorium and the like and/or a radioactive isotope having a known half life in the fluid path and providing a receiving antenna, a device supporting the radioactive element and the receiving antenna being grounded externally of the dry cleaning machine.

As is well known in the art of dry cleaning the so called "graying" of garments occurs periodically during the "washing" or actual dry cleaning operation. Various attempts to control graying have been made and one of the most successful comprises the provision of grounding electrodes in the fluid path of the cleaning fluid in the dry cleaning machine.

It has been determined that "graying" is directly caused by the redeposition of minute soil particles in the garments in the dry cleaning machines usually subsequent to their initial removal from the garments. For example, a dry cleaning machine with new solvent charged therein and continuously circulated through a newly charged filter will become loaded with minute soil particles removed from garments placed therein and sometime all the soil particles will be circulated with the solvent to the filter and retained thereby. While at other times the majority of the soil particles will be redeposited in the garments in the dry cleaning machine despite the continuous circulation of the solvent through the machine and its associated filter. The basic cause of redeposition of soil is believed to lie in the creation of electro static fields in the dry cleaning solvent, the garments in the dry cleaning machine and in the solvent and in the soil particles suspended in the solvent itself by the movement of the garments. The electro static fields which occur in the solvent and the soil particles results in the attraction of the soil particles to the garment where they are retained with the resulting evenly distributed uniformly gray appearance. It has been determined that by directing electrons through the fluid in a dry cleaning machine in a limited area thereof toward a grounded receiving device most if not all of the of the free electro static electrons in the fluid will be affected by the electron flow and conducted to the grounding device and thus removed from the dry cleaning fluid. It has been determined that a source of electrons for such use can comprise a material having trace amounts of radium, actinium, uranium, thorium and radioactive isotopes.

DESCRIPTION OF THE PREFERRED EMBODIMENT

Figure 1:
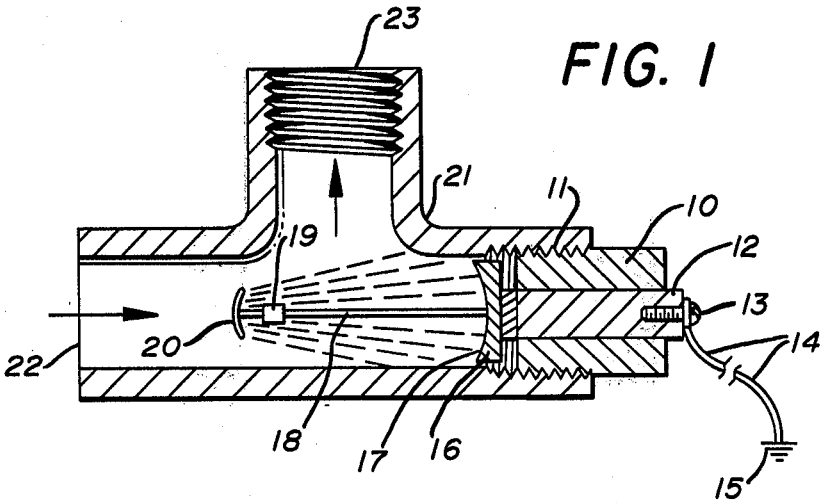
FIG. 1 is a plan view of the electronic static discharge apparatus with parts in cross section and parts broken away.

In the form of the invention chosen for illustration and description herein, the electronic discharge apparatus comprises a plug 10 having an exterior thread pattern 11 thereon such as engageable in a T positioned in the fluid piping of a dry cleaning machine through which the fluid flows as from the washer body to the filter thereof. The plug 10 is provided with an axiel body member 12 of conductive material preferably copper or brass with a screw fitting 13 in one end thereof to which a ground wire 14 can be attached to lead to a ground 15. The other or inner end of the axiel body member 12 extends inwardly of the inner end of the plug 10 and carries a receiving antenna member 16. The receiving antenna having a concave shape on its inner surface 17. A small diameter rod 18 extends from the center of the receiving antenna 16 and carries a pellet of electron emitting material 19 inwardly of its outermost end and a concave metal member 20 is mounted on the end of the rod 18 in spaced relation to the pellet 19. As illustrated in FIG. 1 of the drawing, the plug 10 is shown in threaded engagement in a threaded opening in a T 21 and arrows in FIG. 1 show fluid flow into the T 21 through and end 22 thereof and outwardly of the T 21 through an outlet 23 thereof.

The pellet 19 of electron emitting material may be and preferably is a material having trace elements of radium or actinium or uranium or thorium, etc. or a portion of material containing a radio isotope any and all of which material will produce or emit an electron flow for the pre-determined half life of the radioactive material used. In FIG. 1 of the drawings broken lines indicate the electron flow pattern from the pellet 19 and it will be seen that some of the electrons are reflected by the metal reflected 20 so that most if not all of the electrons flowing from the pellet 19 will be toward the receiving antenna 16. As illustrated in FIG. 1 of the drawings, the flow of the dry cleaning fluid into the T 21 through the open end 22 thereof will thus move through the electron fields indicated by the broken lines and flow outwardly of the T 21 through the opening 23. The electrons comprising an electro static field carried in the dry cleaning fluid flowing through the T 21 as above described will be en-trained by the electron flow from the pellet 19 and directed to the receiving antenna 16 and directed to ground by the axiel body member 12 and the ground wire 14. Additionally the small diameter rod 18 which supports the radioactive pellet material 19 and the member 20 will collect some free electro static electrons which will also be grounded as the rod 18 is directly attached to the receiving antenna 16 and the axiel body member 12 and the ground wire 14.

Figure 2:
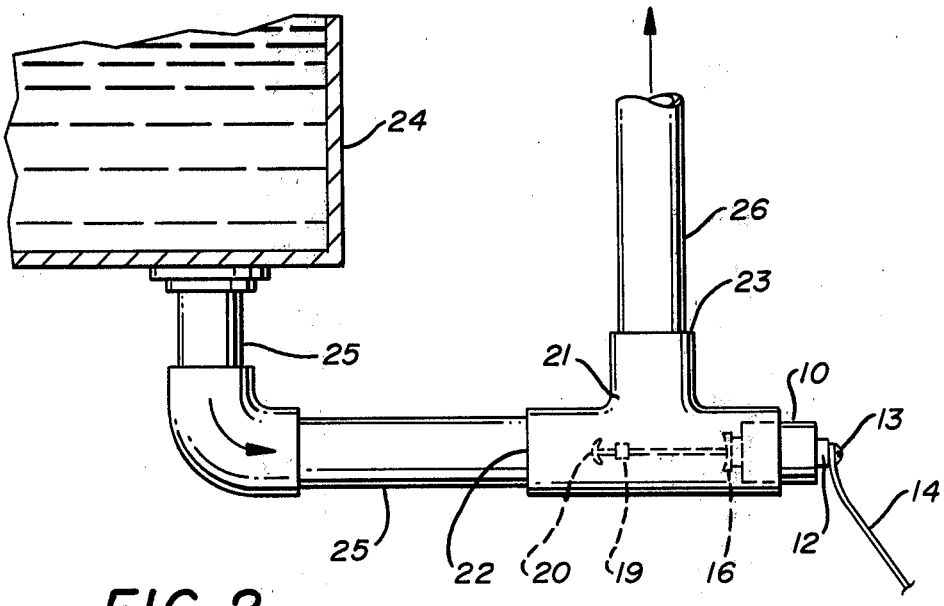
FIG. 2 is a plan view of a preferred form of mounting of the electronic static discharge apparatus on a dry cleaning machine.

By referring now to FIG. 2 of the drawings, the electronic static discharge apparatus will be seen illustrated in communication with the washer body 24 of a dry cleaning machine by piping 25 which communicates directly with the opening 22 in the T 21. The fluid leaves the T 21 through the opening 23 thereof and flows through piping 26 leading to a filter and/or pump of the dry cleaning machine (not shown). The arrangement is such that all of the fluid in the dry cleaning machine washer body 24 is circulated through the piping 25, the T 21 and the piping 26 so that free electrons comprising the electro static field generated by the movement of the fluid and the garments therein in the dry cleaning washer body will be directed through the electrons flowing from or emitted by the electron source 19 and thus captured by the receiving antenna 16 and thus grounded and removed from the fluid in the dry cleaning machine.

Those skilled in the art will observe that when the static electricity in the dry cleaning machine is removed the heretofore damaging graying of garments in the dry cleaning machine is eliminated.

It will thus be seen that a new and useful electronic static discharge apparatus for dry cleaning machines and the like has been disclosed and it will be apparent to those skilled in the art that various changes and modifications may be made therein with respect to the form of the invention disclosed without departing from the spirit of the invention and the scope of the appended claims and having thus described my invention what I claim is:

1. Static discharge apparatus for non-conductive fluids comprising a source of radioactivity, a rod mounting said source of radioactivity and a receiving antenna supporting said rod, a ground and means connecting said receiving antenna and rod to said ground, said source of radioactivity being spaced by said rod with respect to said receiving antenna, said means connecting said receiving antenna and rod to said ground comprising a plug having an exterior thread pattern and a ground wire extending from said plug to said ground.

2. The static discharge apparatus set forth in claim 1 and wherein an member is mounted on said rod in spaced relation to said source of radioactivity and on the opposite side thereof with respect to said receiving antenna.

3. The static discharge apparatus set forth in claim 1 and wherein the means connecting said receiving antenna and rod comprises a plug having an exterior thread pattern whereby said plug may be mounted in a T fitting in the piping of a dry cleaning machine, an axiel body member formed of conductive material extending through said plug, a ground wire attached to the axiel body member on one end and said receiving antenna being mounted on the other end thereof.

4. The static discharge apparatus of claim 1 wherein said receiving antenna is integral with said plug.

* * * * *